US006408948B1

(12) United States Patent
Fontana et al.

(10) Patent No.: US 6,408,948 B1
(45) Date of Patent: Jun. 25, 2002

(54) TUBING HANDLING FOR SUBSEA OILFIELD TUBING OPERATIONS

(75) Inventors: Peter Fontana, Houston; James W. Macfarlane, Katy; Roger W. Fincher, Conroe, all of TX (US)

(73) Assignee: Deep Vision LLC, Houston, TX (US)

( * ) Notice: Subject to any disclaimer, the term of this patent is extended or adjusted under 35 U.S.C. 154(b) by 0 days.

(21) Appl. No.: 09/353,696

(22) Filed: Jul. 14, 1999

Related U.S. Application Data

(60) Provisional application No. 60/092,908, filed on Jul. 15, 1998, and provisional application No. 60/095,188, filed on Aug. 3, 1998.

(51) Int. Cl.[7] ..... E21B 7/12; E21B 33/047; E21B 41/04

(52) U.S. Cl. ..... 166/341; 166/344; 166/358; 175/8; 405/211

(58) Field of Search ..... 166/336, 341, 166/344, 351, 352, 358; 175/8; 405/157, 158, 167, 211.1, 216

(56) References Cited

U.S. PATENT DOCUMENTS

| | | | | |
|---|---|---|---|---|
| 3,419,074 A | * | 12/1968 | Brown | 166/351 X |
| 3,677,016 A | | 7/1972 | Garrigus | 405/202 |
| 3,815,673 A | | 6/1974 | Bruce et al. | 166/0.5 |
| 4,030,310 A | * | 6/1977 | Schirtzinger | 166/658 X |
| 4,063,602 A | | 12/1977 | Howell et al. | 175/7 |
| RE29,562 E | * | 3/1978 | Wray et al. | 166/352 X |
| 4,149,603 A | | 4/1979 | Arnold | 175/7 |
| 4,182,584 A | | 1/1980 | Panicker et al. | 405/224.3 |
| 4,185,694 A | * | 1/1980 | Horton | 166/352 X |
| 4,291,772 A | * | 9/1981 | Beynet | 175/8 X |
| 4,478,586 A | | 10/1984 | Gentry et al. | 441/4 |
| 4,983,072 A | * | 1/1991 | Bell, Jr. | 405/216 |
| 5,533,574 A | * | 7/1996 | Gonzalez | 166/358 |
| 5,591,265 A | * | 1/1997 | Tusch | 405/216 X |
| 5,803,170 A | * | 9/1998 | Garcia-Soule et al. | 166/241.6 |
| 5,850,874 A | | 12/1998 | Burge et al. | 166/77.3 |
| 5,919,004 A | * | 7/1999 | Christensen | 405/216 |
| 5,941,662 A | * | 8/1999 | Weaver | 405/211.1 |
| 6,116,345 A | * | 9/2000 | Fontana et al. | 166/343 |
| 6,220,351 B1 | * | 4/2001 | Tovar De Pablos | 166/189 |

FOREIGN PATENT DOCUMENTS

| | | |
|---|---|---|
| WO | WO98/14686 | 4/1998 |

* cited by examiner

*Primary Examiner*—Thomas B. Will
*Assistant Examiner*—Tara L. Mayo
(74) *Attorney, Agent, or Firm*—Madan, Mossman & Sriram, P.C.

(57) ABSTRACT

A tubing handling for subsea oilfield tubing operations, includes an isolation tube to mechanically and/or chemically protect the drill string and improved passage of the drill string and fluid return line to the drilling vessel that further protects them during drilling use. In addition, the improvements include an automatic safety apparatus to hold against unintended movement of the tubular members under extreme length and weight conditions as well as against human error at the rig. Further, the invention includes multi-segment coiled tubing drill strings that can be adapted to drilling requirements in a deep wellbore.

4 Claims, 4 Drawing Sheets

TUBING HANDLING FOR SUBSEA OILFIELD TUBING OPERATIONS

This application claims the benefit of U.S. Provisional Application No. 60/092,908, filed Jul. 15, 1998 and U.S. Provisional Application No. 60/095,188, filed Aug. 3, 1998.

BACKGROUND OF THE INVENTION

1. Field of the Invention

This invention relates generally to subsea oilfield tubing operations and systems, and more particularly to operations and systems in which tubing is used for subsea wellbores in marine and offshore drilling and wellbore locations.

2. Background of the Art

Oilfield wellbores are drilled by rotating a drill bit conveyed into the wellbore by a drill string. The drill string includes a drilling assembly (also referred to as the "bottom hole assembly" or "BHA") and tubing that carries the drill bit. The tubing may be coiled tubing or jointed pipe. The drilling assembly usually includes a drilling motor or "mud motor" that rotates the drill bit and a variety of sensors for taking measurements of a variety of drilling, formation and BHA parameters. A suitable drilling fluid (commonly referred to as the "mud") is supplied or pumped under pressure from the surface down the tubing. The drilling fluid drives the mud motor and discharges at the bottom of the drill bit. The drilling fluid returns uphole via the annulus between the drill string and the wellbore and is returned to the surface work station via a return line.

For drilling wellbores under water (referred to in the industry as "offshore" or "subsea" drilling), a supply of tubing is carried at the surface work station (for example, located on a vessel or platform). A rig, which may have one or more tubing injectors, is used to move the tubing into and out of (trip) the wellbore. U.S. Pat. No. 08/911,787, assigned to the assignee of this application, provides certain methods of injecting tubing into subsea wellbore, which is incorporated herein by reference as if fully set forth herein. A riser, which is formed by joining sections of casings or pipes, maybe deployed between the surface work station and the wellhead equipment. The riser is utilized to guide the tubing toward the wellhead. The riser also serves as a conduit for the fluid returning from the wellhead to the sea surface. The riser is substantially larger in diameter than the wellbore and is designed so as not to leak the drilling fluid into the surrounding water. To deploy the riser, sections of pipe (usually 30–40 feet long) are serially connected at the drilling platform and deployed under water. Such large diameter jointed pipes or tubing are very heavy and thus impose significant loads on the surface work station and in particular the rigs and injectors used to deploy the riser.

One suitable injector for deploying the riser is shown in U.S. Pat. No. 5,850,874, commonly assigned to the applicant. While the high speed operation of such injectors can be useful in reducing the time for deployment of the tubular riser, holding the upper reach of a long string of riser against slippage in the injector and against human error in the operation of the injector can be a problem. Once the injector loses its hold on the riser, it is free to fall to the sea bed, with resultant damage to the riser and other subsea equipment. Similar problems can arise with drill strings or other tubing strings in subsea operations in deep water and/or in deep wellbores. Such drill strings are thus also long and heavy, so that they too must be securely held in the injector. Failure to do so will result in the drill string dropping into the wellbore, which may be difficult or perhaps impossible to retrieve.

In an alternative design to the above-noted tubular riser for conveying the return fluid from the subsea wellhead to the surface work station, the return line may be separate and spaced apart from the drill sting tubing. Such return lines are typically smaller and lighter than the jointed pipe/tubing riser, and indeed may be constructed of a flexible, non-metallic material. However, such construction results in the return line leaving the drill string tubing unprotected from the elements of the subsea environment. Indeed, the return line may actually come to interfere with the movement of the tubing toward and away from the subsea wellbore, if the surface work station is a ship or other moveable platform that allows the return line and the tubing to become twisted or wrapped together, upon angular movement of the platform. It is known that the water currents near the sea surface can cause great turbulence in the drilling equipment that extends from the drilling vessel to the wellbore. It is also known that sea water corrodes the drilling equipment that extends from the drilling vessel to the wellbore.

A riser that extends the full distance from the surface to the wellhead to hold drill fluid protects the drilling equipment extending from the vessel to the wellbore both mechanically, such as from upper level turbulence, and chemically, such as from corrosion. Applicants, however, have found that such turbulence is relatively minor past 150–200 feet from the sea surface and that corrosion is also relatively small after such depths.

SUMMARY OF THE INVENTION

The methods and apparatus of this invention overcome many of these tubing handling problems encountered in subsea tubing handling operations. For the problem of securely holding the upper reach of heavy tubular strings suspended from the surface work station, whether the string be the riser, the drill string or any other oilfield work string or whether it is a string of coiled tubing or jointed pipe, this invention provides an automatic safety device to prevent the loss of such string. This safety device supplements the rig or injector, by providing an automatic stop at the surface work station to grip and hold the string if the rig or injector does not. Indeed, such safety device is even useable at on-shore and shallow water drilling sites having shorter lengths of string and thus are at less risk of lost pipe for mechanical (if not operator error) reasons.

The present invention further provides for the reduction in the overall weight of the drill string and/or work string formed from continuous or coiled tubing suspended from the surface work station toward a work site in a wellbore. Such string has a first length or segment of coiled tubing shorter than the total length needed to reach from the surface work station to the wellbore work site, and second or upper length of coiled tubing to make up the difference having characteristics different from the first or lower length of coiled tubing. A tubular connector is provided to secure the lengths together so as to preserve the overall mechanical and pressure integrity of the string. Thus, the string can be designed to have a lighter and more flexible lower segment and a stronger (and perhaps larger) upper segment. Other differences in characteristics as between the length of tubing are also contemplated.

Similarly, the invention enables the use of a separate and distinct return line (rather than a riser) without the problems of leaving the drill string unprotected and avoiding the tendency of the return line and the drill string to wrap together. For the latter problem, the work moveable platform is provided with a turntable or other moveable device for passage of both the drill/work string and the return line thereto at spaced apart locations and then holding the string and return line in a predetermined spaced relationship. This reduces the tendency of these members to twist about each other.

The present invention further eliminates the need for the complete, full length riser. In the present invention a relatively short (about 200 feet) large diameter tubing (referred to herein as an "isolation tube") may be deployed below the drilling surface work platform to negate the impact of turbulence and the corrosive effect of the sea water near the sea surface. The isolation tubing may be formed of a lighter gage material than a conventional riser and is filled with a suitable non-corrosive, non-water soluble fluid whose fluid density is less than that of the sea water. Such a fluid remains within the isolation tubing. A separate return line carries the return fluid from the wellhead to the surface work station.

Examples of the more important features of the invention have been summarized rather broadly so that in order that the detailed description thereof that follows may be better understood, and so that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawings, in which like elements have been given like numerals.

DETAILED DESCRIPTION OF PREFERRED EMBODIMENTS

Figure 1:
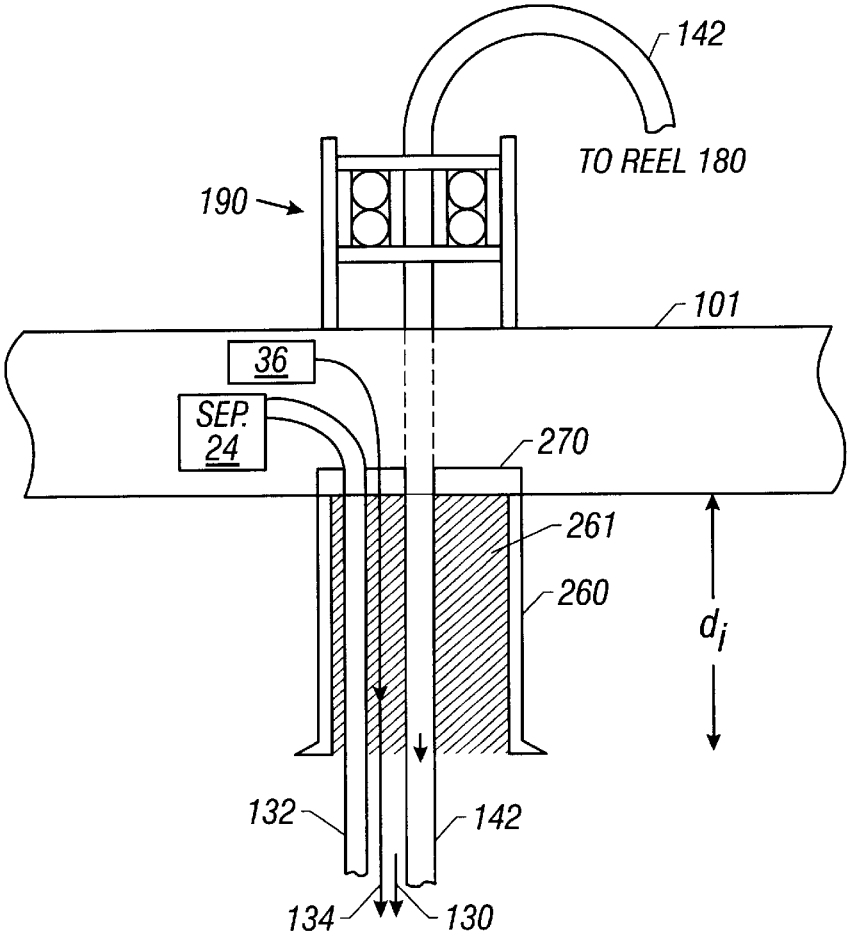
FIG. 1 shows a schematic diagram of a section of the riserless subsea drilling system of this invention wherein a relatively short isolation tube is deployed below the vessel to mechanically and chemically protect the drilling equipment extending from the sea surface to the wellhead.

FIG. 1 is a schematic diagram of a section of a riserless subsea drilling system within the scope of the invention having a relatively short isolation tubing 260 projecting below the surface work station, such as vessel 101. The Applicants have found that heavy turbulence usually occurs up to about 200 feet below the sea level. The typical jointed pipe/tubing riser (not shown) utilized in the prior art systems serves as a barrier to such turbulences. Since the riser is filled with the drilling fluid, it also serves to chemically protect the tubing from the corrosive affects of the sea water which is most prevalent up to 300 feet depth. In the present invention, for deep water drilling, an isolation tube, such as 260, may be deployed below the vessel 101. The tubing 260 is of lighter gage material than the conventional riser and is preferably filled with non-corrosive, non-water soluble, environmentally friendly fluid 261, which is lighter in density than the sea water. The fluid 261 is buoyed in sea water and thus remains within the isolation tube 260. Oilfield tubing, such as drill sting tubing from a suitable supply, such as reel 180 for continuous or coiled tubing, is surrounded by the isolation tube 260. A return fluid line 132 and control/gas injection lines 134 may also be routed through the isolation tube 260. The isolation tube 260 is of a size, rigidity and strength to mechanically protect the tubing 142, return line 132, and the gas injection/control line 134 from the water turbulences, while the fluid 261 chemically protects such elements from the corrosive effects of the sea water. The isolation tube 260 is easier to install than a full-length riser, is much shorter and thus less expensive and depending upon the length may utilize only a fraction of the fluid 261 compared to a deep sea riser.

The isolation tube 260 is also much lighter than a full-length riser and thus imposes less load on the vessel 101 and the rig, which may include one or more injectors 190. In addition, the fluid 261 held in the isolation tube 260 may have properties other than anti-corrosive properties. For example, it may alternatively or in addition, have anti-fouling, anti-freeze and/or lubricating properties.

Figure 2:
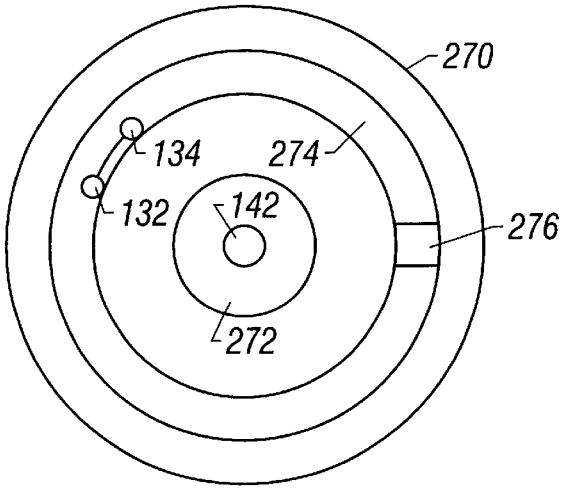
FIG. 2 shows a schematic diagram of a device for maintaining the fluid return line from wrapping around the drill string when the drilling vessel rotates during the drilling operations.

The drilling vessel 101 tends to rotate about its axis over time, which can cause the return line 132, which is separated and spaced apart from the tubing 142 and the gas injection/control line 134 to wrap around the tubing. To prevent this, a device such as that shown at 270, shown in FIG. 2, is mounted on the vessel 101. The device 270 has a through opening 272 which allows the passage of the tubing 142. A slot 274 made around the opening 272 may be used to pass the return line 132 and the gas injection/control line 134 between the vessel 101 and the wellhead equipment 130. The slot 274 may cover 360° or may include a stop 276 that enables the line 132 to move about the tubing 142 substantially 360 degrees. The lines 132 and 134 may be held together or spaced apart. The device 270 may also be made to rotate about the tubing 142. In either embodiment, the device 270 keeps the tubing 142 in a predetermined spaced relation to the return line 132 and gas injection/control line 134.

In certain instances during wellbore operations, it is desirable to stop the movement of the tubing due to some emergency, such as the detection of a kick, insufficient pressure in the wellbore or equipment failure, etc. A brake may be used for such purpose. The prior art brakes abruptly apply force on the tubing which often severely damages the tubing or in some cases breaks the tubing. Continuous tubing may exceed 10,000 feet in length. If the tubing is severely damaged or broken, it must be replaced. Replacement of the tubing is very expensive and also requires tripping the tubing string out of the wellbore, which can cause several hours of down time and for deep sea operations can cost several thousand dollars per hour. Therefore, it is desirable to have a brake system that can effectively stop the tubing movement without causing a catastrophic failure of the tubing. The present invention provides a safety braking system and method for controllably and effectively braking and holding the tubing. An embodiment of such as system is shown in FIGS. 3A–3C.

Figure 3A:
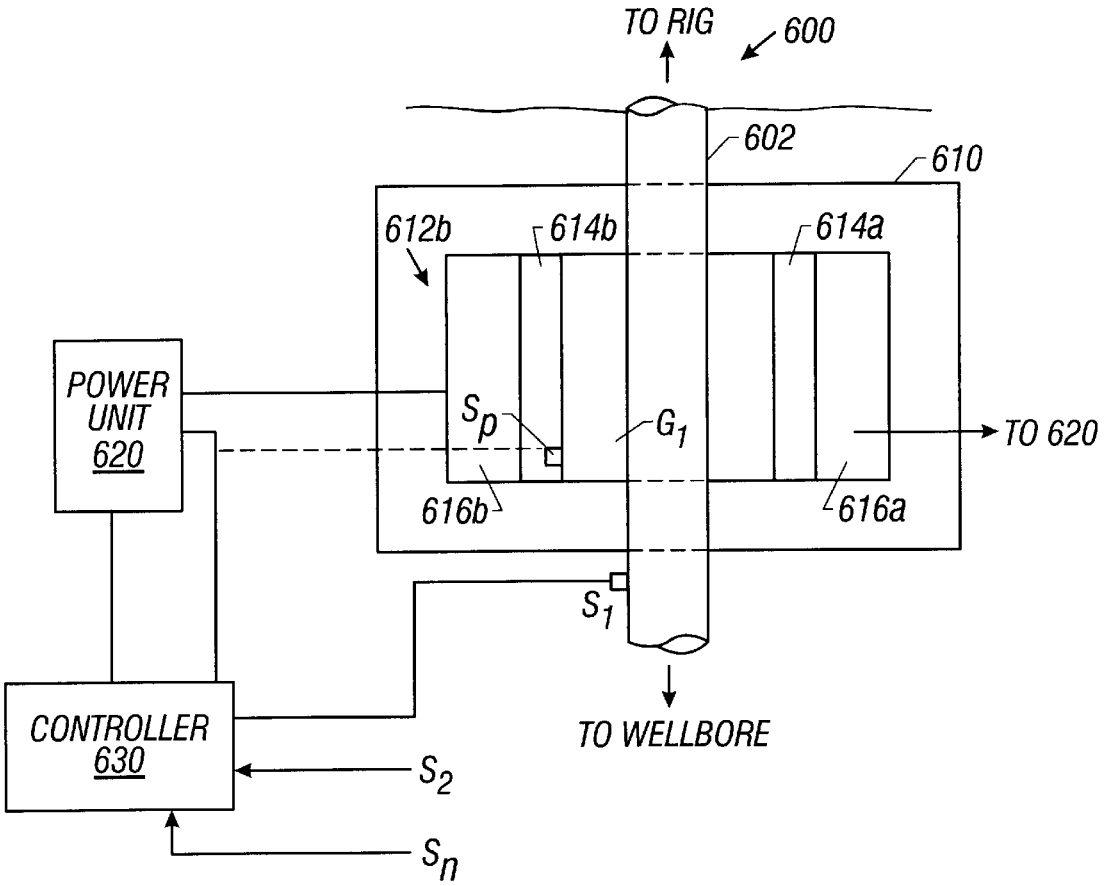
FIG. 3A is a schematic diagram of the automatic safety apparatus of this invention shown in its open mode of operation.

FIG. 3A is a schematic illustration of a tubing deployment safety system 600 that includes an opening receiving tubing 602 and one or more tubing engagement members 614*a*–614*b* moveably mounted on a frame or support member 610 on the surface work station. Each engagement member 614*a*–614*b* includes an associated activation mechanism 616*a*–616*b*. For example, member 614*a* includes a gripping face and is associated with an activation mechanism member 616*a*. The activation mechanism 616*a*–616*b* is coupled to power unit 620. A suitable controller or control unit 630 controls the operation of the power unit 620. The controller 630 receives input from one or more sensors S1–Sn and in response thereto and other instruction received or stored therein operates the power unit to engage or disengage the engagement members 614*a*–614*b*. During normal operation, the system 600 remains in disengaged position, i.e., the engagement members 614*a*–614*b* are not engaged with the tubing. There remains a gap G1 between the tubing 602 and the engagement members. One of the parameters monitored by the controller is preferably the actual motion of the tubing 602 compared to a predetermined limit. Other parameters may include the detection of a kick or pressure at the wellhead or in the wellbore. The controller 630 activates the power unit 620, which provides the required power to the activation mechanism 616*a*–616*b*, which moves the engagement members toward the tubing 602. The force applied on the engagement members is controllably or progressively increased until the tubing 602 stops.

Figure 3B:
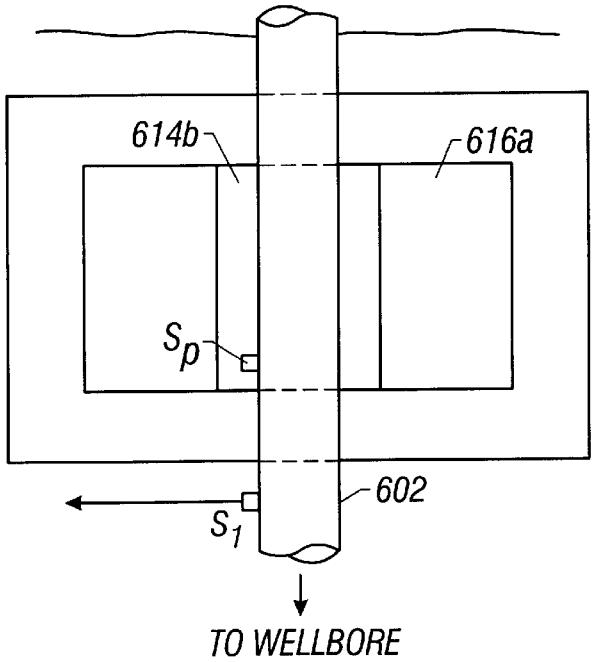
FIG. 3B is a schematic diagram similar to FIG. 3A showing the apparatus in its tubing engaging mode of operation.

FIG. 3B shows the safety system 600 in the engaged position. A sensor Sp may be provided to determine the amount of the force being applied by the engagement members on the tubing 602. The controller 630 may be programmed to utilize this feedback in operating the power unit 620, thereby providing a closed loop control system.

Figure 3C:
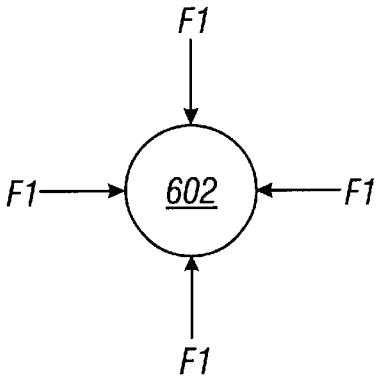
FIG. 3C illustrates the uniform application of force on the tubing by various engagement members.

FIG. 3C shows that the force F1 is uniformly applied on the tubing by all of the various engagement members, four of which are illustrated, for example, by their forces F1 in FIG. 3C. The controller 630 preferably is microprocessor based system or a general purpose computer that is capable of handling the desired instructions. The controller can vary the application of the force as to the brakes to avoid "skidding" wherein the tubing is essentially unrestrained. This is done by reducing the applied force when skidding is detected so as to increase the frictional force between the engagement members 614*a*–614*b* and the tubing 602.

The engagement members may be of any number or type, including wedges having resilient liners, such as an elastomer or any other composite material, facing the tubing 602. There may only be one engagement member, such as an annular device with an internally inflating bladder. The bladder surrounds the tubing 602 and when the bladder is activated, it inflates radially or inward, i.e., toward the tubing 602, thereby engaging the tubing. The length of the bladder is selected to provide the desired gripping force. Similarly, the surface area of the engagement members 614*a*–614*b* is selected to provide the required gripping force. More than one bladder or sets of engagement members may be utilized arranged longitudinally along the tubing 602. The activation mechanism 616*a*–616*b* may be pneumatically, hydraulically, electrically, electromagnetically operated or by any other suitable method. The safety apparatus 600 may be disposed at the rig or for subsea applications, under water or at the surface, or even at a land well.

The activation mechanisms 616*a*–616*b* move their corresponding engagement member between a first or disengaged position, spaced laterally away from the tubing 602, and a second or engaged position in pressurized engagement with the tubing. In the first position, the engagement members allow for the movement of the tubing into and out of the wellbore. In the second position of the engagement members, the activation mechanism controllably increases the force applied by the members to the tubing so as to slow or stop the movement of the tubing. At least one of the sensors senses a parameter indicative of an operating condition of the tubing. More particularly, when the apparatus is used in conjunction with an injector, such as injector 190, the sensor senses a parameter indicative of the operation of the tubing selected from the group of operating parameters consisting of the speed and movement of the tubing (including downward movement into the wellbore or upward movement, such as in an underbalanced or blow-out situation), the gripping force of the tubing by the injector and the slippage or differential speed of the tubing relative to the operation of the injector. The safety apparatus 600 of this invention is useable both with coiled or jointed tubing that is employed for any oilfield operation purpose such as a riser, drill string or a work string.

As described above, coiled or reeled tubing is frequently used as the conveying member of a drilling string utilized for drilling wellbores. The coiled tubings currently utilized are continuous flexible metallic tubulars having uniform external diameters so that they may be moved by commonly available tubing injectors, which are usually designed only to handle continuous tubings with uniform outside diameter. The length of the tubing depends upon the total depth of the proposed wellbore. If the wellbore is to be drilled to 15,000 feet, then the tubing used is at least 15,000 feet. Very deep wellbores thus require very long tubings, which then require equally large reels. Reels of 40 feet diameter are being used in some instances. Such reels are expensive to make, difficult to transport and require large rig surface area, which is at a premium especially for offshore platforms and vessels.

Injectors, such as described herein above, have adjustable openings and can accommodate different diameter tubings. In one aspect, the present invention utilizes multiple field connectable tubings of the same or different outside diameters. In this manner, shorter reeled tubings may be utilized which can be carried by different lateral segments of a single large reel or more than one smaller reel.

Figure 4A:
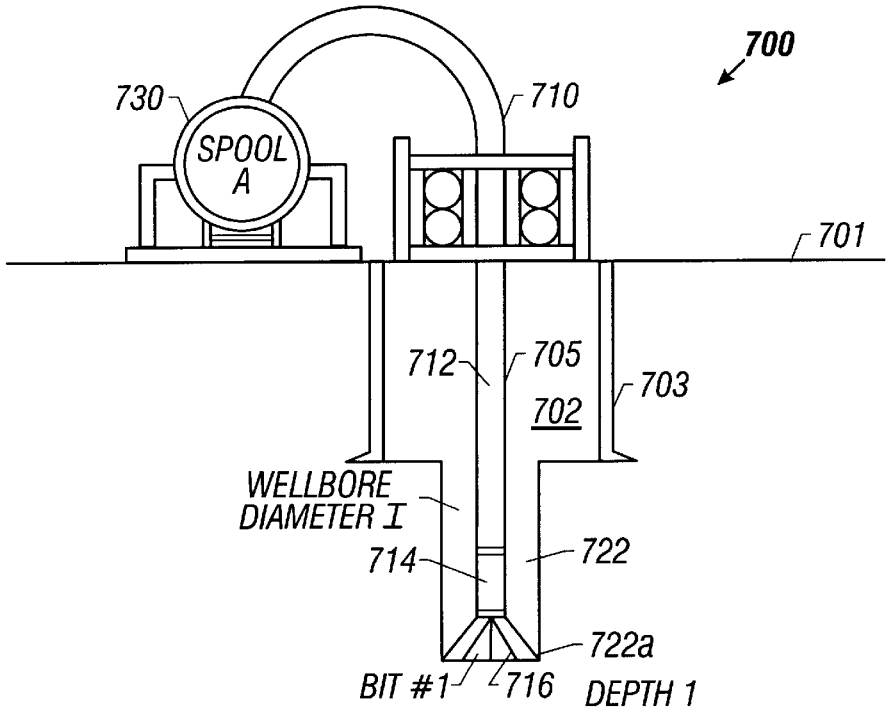
FIGS. 4A–4B are schematic diagrams of the multiple segment coiled tubing drill string of this invention, with FIG. 4A showing drilling with a drill string of one segment of coiled tubing, FIG. 4B showing drilling with a multiple segment drill string.
Figure 4B:
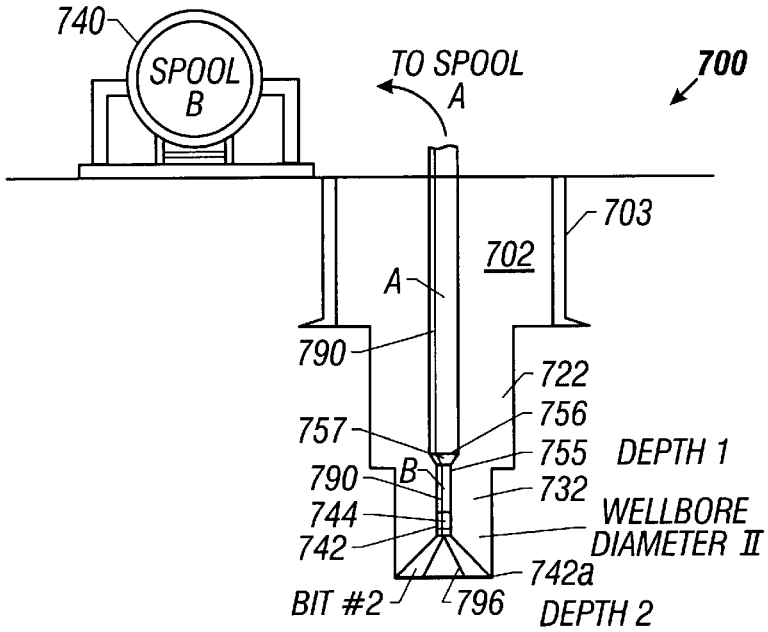

FIGS. 4A–4B schematically illustrate one method of using multiple reeled tubings for oilfield wellbore operations. To drill a wellbore, a relatively large bore 702 is made to shallow depth and casing 703 is installed to avoid hole collapse near the surface. A drill string 705 is then used to drill the wellbore. The drill string includes a drill bit 716 carried by a bottom hole assembly (BHA) 714 which is attached to the bottom end of a reeled tubing 712. The tubing 712 is reeled on a reel 730, which is placed at the rig site 701. In the example of FIGS. 4A–4B the wellbore to be drilled has an upper larger diameter section and a lower smaller diameter section. Referring to FIG. 4A, the wellbore 722 is drilled to a first depth 722*a* with a first drill 716 carried by the first tubing 712 supplied by the reel or spool 730.

FIG. 4B illustrates the use of a second reeled tubing 740 in conjunction with the first tubing 712 to drill the lower section 732 of the wellbore to a second depth 742*a*. To drill the wellbore to depth 742*a*, the drill string 705 is retrieved. The second drill bit 796 carried by the second tubing 742 is conveyed to the bottom 722*a* of the wellbore 722. If the length of the second tubing 742 is less than the total depth 722*a* of the downhole work site, the driller attaches the lower end 757 to the first tubing 712 to the upper end 755 of the second tubing 742 with a field connector 757. The connector 757 may be a separate member that is adapted to attach at one end to the upper end of the tubing 742 and at the other end to the lower end 756 of the first tubing 712. The connector 757 may include two segments, one segment mounted on one end of each of the tubings 712 and 742. If the second tubing is longer than the depth 722*a*, then the connector 757 is attached after exhausting the second tubing 742. The drill string, with both the tubings, is then used to continue the drilling of the lower section 732. Additional tubings of shorter lengths than the total well depth may be used in the manner described above. Such tubings may be carried on a separate reels, which are smaller than a single large reel, easier and less expensive to make and have much smaller foot prints.

Figure 4C:
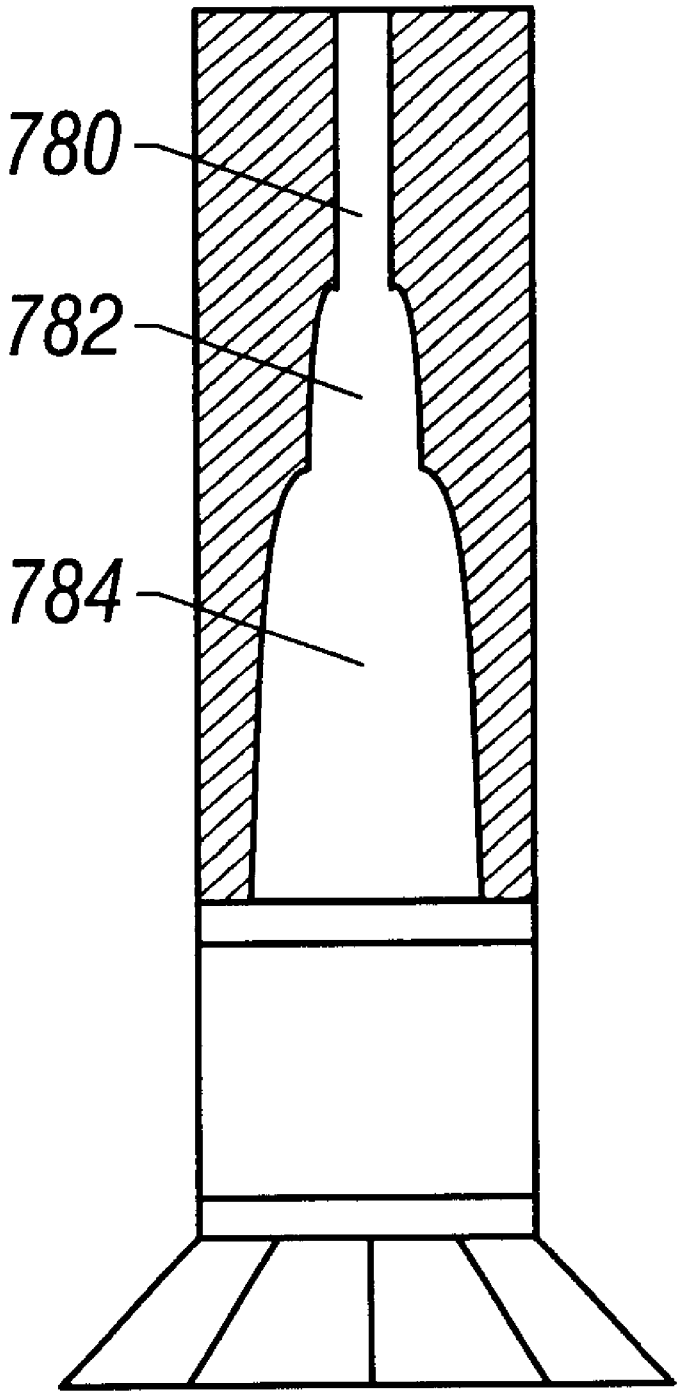
FIG. 4C illustrates the different internal dimensions of various segments of tubing.

Alternatively, the tubings may be of same external dimensions and carried on different annular segments of a common reel. However, the segments of tubing may be different internal dimensions such as shown at 780, 782 and 784 in FIG. 4C. The multiple tubings of the present invention offer several advantages over single tubing: as noted above, such tubings may be carried by relatively small reels, which are easier to manufacture and transport and are easier to handle at the rig site, multiple tubings may require smaller power units and if a particular tubing segment suffers a catastrophic failure, only that segment will need to be replaced instead of the entire tubing. Similarly, segments subject to greater wear may be replaced earlier than the other segments of the drill string.

Thus, the method of performing oilfield operations (drilling, workover, logging, etc.) with a multiple segment drill string from lengths of coiled tubing involves conveying the drill string to a downhole work site with a first length of coiled tubing shorter than the total distance from the surface work station to the final downhole work site. Thereafter, a second length of coiled tubing is secured to the first length of coiled tubing by sealingly securing the ends of the lengths of tubing. The second length of tubing has different characteristics from that of the first. The drill string having both first and second lengths is then extended to the final downhole work site. The first and second lengths of tubing differ in the characteristics of being of different cross-sectional dimensions, materials of construction, tensile strength, reels on which the tubing was stored and/or the lateral segments of the same reel on which they were stored. The field connector 756 may be of one or several tubular parts and has mechanical tubing connections and hydraulic seals. These connections and seals are such that when the tubular connector is connected to the lengths of tubing, the connector preserves the mechanical and hydraulic integrity of the drill string by providing mechanical strength and pressure ratings substantially equal to that of at least one of the lengths of coiled tubing. In addition, the connector may provide for an electrical and/or optical connection between conductors such as conductors 790 in the lengths of coiled tubing. The multiple segment drill string of this invention is useable not only in marine and offshore applications, but also land based and shallow water drilling, with the surface work station thus being on land or at the surface of the shallow water.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A subsea system for performing subsea oilfield tubing operations, comprising:

(a) a work station at the surface of an offshore location;

(b) a supply of tubing at the work station for supplying a string of work tubing extending down from a work platform to a subsea work location;

(c) a rig at the work station for moving the work tubing from the surface down to the subsea work location;

(d) a fluid return line extending from the subsea work location to the surface for return of the fluid to the work station, the return line being separated and spaced apart from the work tubing;

(e) a second, isolation tube of larger inner dimensions than the exterior dimensions of the work tubing surrounding an upper portion of the work tubing during subsea operations and extending down from adjacent the work station toward but stopping short of the subsea work location, with the size, rigidity and mechanical strength of the second, isolation tube being sufficient to mechanically protect said work tubing from exposure to turbulence in the sea adjacent the surface at the offshore location; and (f) a device on the surface work station having separate openings allowing the passage of the work tubing and the return line therethrough, said device maintaining the return line and the work tubing in predetermined spaced relation when said platform rotates about the work tubing wherein the opening for the return line is a slot extending around the opening for the work tubing such that the return line is able to move at least partially around the work tubing.

2. A subsea system for performing subsea oilfield tubing operations, comprising:

(a) a work station at the surface of an offshore location;

(b) a supply of tubing at the work station for supplying a string of work tubing extending down from the work platform to a subsea work location;

(c) a rig at the work station for moving the work tubing from the surface down to the subsea work location;

(d) a fluid return line extending from the subsea work location to the surface for return of the fluid to the work station, the return line being separated and spaced apart from the work tubing;

(e) a second, isolation tube of larger inner dimensions than the exterior dimensions of the work tubing surrounding an upper portion of the work tubing during subsea operations and extending down from adjacent the work station toward but stopping short of the subsea work location, the work tubing and the second, isolation tubing forming an annular space therebetween which is generally open at its bottom to facilitate the passage of the work tubing through the second tube;

(f) a quantity of a fluid in the annular space between the work tubing and said second, isolation tube to chemically protect the work tubing in the second, isolation tube; and (g) a device on the surface work station having separate openings allowing the passage of the work tubing and the return line therethrough, said device maintaining the return line and the work tubing in predetermined spaced relation when said platform rotates about the work tubing wherein the opening for the return line is a slot extending around the work tubing such that the return line is able to move at least partially around the work tubing.

3. The subsea system of claim 2 wherein said fluid in the annular space has at least one chemical property selected from the group consisting of anti-fouling, anti-corrosion, anti-freeze, or lubricating properties.

4. A wellbore system for performing downhole subsea wellbore operations, comprising:

(a) a work station at the surface of an offshore location;

(b) a supply of tubing at the work station for supplying a string of work tubing extending down from a work platform to a subsea work location;

(c) a pump at the work station for delivery of fluid under pressure to the upper end of the work tubing;

(d) a rig at the work station for moving the work tubing from the work station down to the subsea work location;

(e) a fluid return line extending from the subsea work location to the surface for return of the fluid to the work station, the return line being separated and spaced apart from the work tubing;

(f) a second, isolation tube of larger inner dimensions than the exterior dimensions of the work tubing surrounding an upper portion of the work tubing during subsea operations and extending down from adjacent the work station toward but stopping short of the subsea work location, the work tubing and the second, isolation tube forming an annular space therebetween which is generally open at its bottom to facilitate the passage of the work tubing through the second, isolation tube; and (g) a device on the surface work station having separate openings allowing the passage of the work tubing and the return line therethrough, said device maintaining the return line and the work tubing in predetermined spaced relation when said platform rotates about the work tubing wherein the opening for the return line is a slot extending around the work tubing such that the return line is able to move at least partially around the work tubing.

* * * * *